US007362343B2

(12) United States Patent
Park

(10) Patent No.: US 7,362,343 B2
(45) Date of Patent: Apr. 22, 2008

(54) APPARATUS AND METHOD OF CORRECTING COLOR REGISTRATION IN ELECTROPHOTOGRAPHIC PRINTER

(75) Inventor: Sang-Sin Park, Suwon-si (KR)

(73) Assignee: Samusung Electronics Co., Ltd., Suwon-si (KR)

( * ) Notice: Subject to any disclaimer, the term of this patent is extended or adjusted under 35 U.S.C. 154(b) by 424 days.

(21) Appl. No.: 11/198,833

(22) Filed: Aug. 8, 2005

(65) Prior Publication Data

US 2006/0119690 A1 Jun. 8, 2006

(30) Foreign Application Priority Data

Dec. 2, 2004 (KR) ..... 10-2004-0100343

(51) Int. Cl.
*G03G 15/01* (2006.01)
*B41J 2/435* (2006.01)
*B41J 2/41* (2006.01)

(52) U.S. Cl. ..... 347/116; 347/235; 399/301

(58) Field of Classification Search ..... 347/116, 347/235, 250; 399/301
See application file for complete search history.

(56) References Cited

U.S. PATENT DOCUMENTS

| | | | | |
|---|---|---|---|---|
| 6,064,499 | A * | 5/2000 | Kim | 358/505 |
| 6,418,295 | B1 * | 7/2002 | Sato | 399/301 |
| 2001/0000968 | A1 * | 5/2001 | Hata | 347/116 |

FOREIGN PATENT DOCUMENTS

| | | |
|---|---|---|
| JP | 06-324545 | 11/1994 |
| JP | 2000-199987 | 7/2000 |
| JP | 2000-305336 | 11/2000 |
| JP | 2000-305340 | 11/2000 |
| JP | 2001-005364 | 1/2001 |
| KR | 1999-0001411 | 1/1999 |
| KR | 1999-0015003 | 3/1999 |
| KR | 2003-0042579 | 6/2003 |

OTHER PUBLICATIONS

Machine-generated translation of JP 2001-005364.*
Machine-generated translation of JP 2000-305340.*

* cited by examiner

*Primary Examiner*—Huan Tran
(74) *Attorney, Agent, or Firm*—Roylance, Abrams, Berdo & Goodman L.L.P.

(57) ABSTRACT

Disclosed are an apparatus for and a method of correction color registration in an electro-photographic printer. An apparatus for correcting color registration in an electro-photographic printer, in which exposure start points of each color unit for a photosensitive drum are adjusted to superpose images developed in a plurality of colors on matching positions of a transfer belt, includes an exposure unit to project light beams on the photosensitive drum to form latent images of one or more marks for each color unit. A developing unit is also disclosed to generate developed images by developing the latent images of the marks and a mark sensing unit is provided to detect the developed images transferred on a surface of the transfer belt for a predetermined time period. A color registration controller stores information on time points at which the developed images are detected and compares the number of the time points with the number of the marks. Thus, the color registration controller controls the exposure start points in response to the compared result.

19 Claims, 7 Drawing Sheets

APPARATUS AND METHOD OF CORRECTING COLOR REGISTRATION IN ELECTROPHOTOGRAPHIC PRINTER

CROSS-REFERENCE TO RELATED APPLICATIONS

This application claims the benefit of 35 U.S.C. 119(a) of Korean Patent Application No. 10-2004-0100343, filed on Dec. 2, 2004, the entire disclosure of which is hereby incorporated by reference.

BACKGROUND OF THE INVENTION

1. Field of the Invention

The present invention relates to a color registration correction system for an electro-photographic printer. More particularly, the present invention relates to an apparatus for and a method of correcting color registration in an electro-photographic printer, by which correction values of the color registration can be determined without errors.

2. Description of the Related Art

A typical electro-photographic printer such as a color laser printer includes four photosensitive drums, an exposure unit, a developing unit, and an image carrying medium, such as a transfer belt. Four photosensitive drums correspond to four colors, such as yellow, cyan, magenta, and black, respectively. The exposure unit projects light beams to each photosensitive drum to form electrostatic latent images which corresponds to a desired image.

The developing unit develops the electrostatic latent images formed by the exposure unit for each color with a developing solution. The image carrying medium receives the images developed in the photosensitive drums in turn, and the received images are superimposed to form a complete image. Then, the complete image is transferred to a sheet of paper.

In order to print a clear color image, it is important to accurately arrange start positions for each color of the developed images to be transferred from each photosensitive drum. It is also important to accurately arrange end positions where the transfer of the images is complete. For this purpose, exposure start points in the exposure unit should be accurately set up for each photosensitive drum based on a driving speed of the image carrying medium. The accurate setting of the exposure start points for each color is referred to as color registration.

However, even when the exposure start points are accurately set up to initial values, registration errors may be generated. For example, when printing may be effected by expansion of a roller for driving the image carrying medium may be expanded due to the heat generated during the printing. In other words, if the diameter of the roller is changed, the transfer speed of the image carrying medium is correspondingly changed even when the rotation rate of the roller is constant. Therefore, proper color registration cannot be achieved even when the exposure is started at the exposure start points based on the initial values. Consequently, the exposure start points set to initial values should be dynamically controllable and correctable based on information from the surrounding conditions to obtain a clear color image. Such dynamic correction of the registration errors is referred to as color registration correction.

In conventional color registration correction, the exposure unit forms particular marks on each photosensitive drum, and the marks are developed and transferred to the image carrying medium. Then, positions of the marks are detected by sensors to identify registration errors in positions of the marks for each color. Correction values are calculated based on the detected positions of the marks to rearrange the exposure start points for each color. In this case, if there is any defect or disturbance around the marks on the surface of the image carrying medium, the sensors may detect the defect as a true position mark, and a false correction value may be calculated.

SUMMARY OF THE INVENTION

The present invention provides an apparatus for and a method of correcting color registration in an electro-photographic printer. Correction values for the color registration can be accurately calculated without registration errors based on the information on the detected mark positions, wherein the apparatus has a plurality of detection memory devices to correspond to the number of marks generated by the exposure unit.

Also the present invention provides a computer readable recording medium to record a program to execute a method of correcting color registration in an electro-photographic printer, by which correction values for the color registration can be accurately calculated without registration errors based on the information on the detected mark positions, wherein the apparatus has a plurality of detection memory devices and preferably more than the number of marks generated by the exposure unit.

According to an aspect of the present invention, there is provided an apparatus for correcting color registration in an electro-photographic printer, in which exposure start points of each color unit for a photosensitive drum are adjusted to superpose images developed in a plurality of colors on matching positions of an image carrying medium. The apparatus comprises an exposure unit projecting light beams on the photosensitive drum to form latent images of one or more marks for each color unit. A developing unit generates developed images by developing the latent images of the marks. A mark sensing unit detects the developed images transferred on a surface of the image carrying medium for a predetermined time period. A color registration controller stores information on time points at which the developed images are detected to compare the number of the time points with the number of the marks. Thus, the exposure start points are controlled in response to the compared result.

The color registration controller preferably comprises a detection memory unit to store the time points detected by the mark sensing unit and a correction determination unit to determine whether or not the number of the time points is equal to the number of the marks. Additionally, the color registration controller includes a correction value calculation unit to calculate the exposure start points of the exposure unit for each color unit based on the time points stored in the detection memory unit if the number of the time points is equal to the number of the marks.

The detection memory unit may have detection memory devices more than the number of the marks and controls the exposure unit for each color unit based on the time points stored in the detection memory devices. Each of the detection memory devices is configured to store information on only one time point and is initialized if the information on the time point is not stored.

The color registration controller may further comprise a detection controller to instruct the mark sensing unit to operate for a predetermined time period. The predetermined time period is longer than a time period required for the mark sensing unit to detect the developed images.

The detection controller may initialize the information stored in the detection memory unit if the number of the time points stored in the detection memory unit is not equal to the number of the marks.

The color registration controller may further comprise a disturbance removal unit to initialize a stored time point which is not within an allowed error range of an expected timing value. If the number of the time points stored in the detection memory unit is not equal to the number of the marks then the expected timing value is obtained by predicting a time point to be detected by the detection controller.

According to another aspect of the present invention, there is provided a method of correcting color registration in an electro-photographic printer in which exposure start points of each color unit for a photosensitive drum are adjusted to superpose images developed in a plurality of colors on matching positions of a transfer belt. The method comprises the steps of forming latent images of one or more marks on the photosensitive drum for each color unit by projecting light beams onto the photosensitive drum which develops the latent images of the marks formed on the photosensitive drum and transferring the developed images onto the transfer belt; detecting the developed images transferred onto the image carrying medium for a predetermined time period; storing information on time points at which the developed images are detected; and comparing the number of the stored time points with the number of the marks and adjusting the exposure start points in response to the compared result, wherein the developed image is generated by developing the latent images.

According to still another aspect of the present invention, there is provided a computer readable recording medium for storing at least one computer program to comply with a method of correcting color registration in an electro-photographic printer, in which exposure start points of each color unit for a photosensitive drum are adjusted to superpose images developed in a plurality of colors on matching positions of an image carrying medium. The method comprises the steps of forming latent images of one or more marks on the photosensitive drum for each color unit by projecting light beams onto the photosensitive drum; developing the latent images of the marks formed on the photosensitive drum and transferring the developed images onto the image carrying medium; detecting the developed images transferred onto the image carrying medium for a predetermined time period; storing information on time points at which the developed images are detected; and comparing the number of the stored time points with the number of the marks and adjusting the exposure start points in response to the compared result, wherein the developed image is generated by developing the latent image.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF EXEMPLARY EMBODIMENTS

Exemplary embodiments of the present invention will now be described more fully with reference to the accompanying drawings, in which exemplary embodiments of the invention are shown. The meaning of terminology used herein should be determined in consideration of functionality of various components of the present invention, and it may be variable depending on a user's or operator's intention, or custom in the art. Therefore, corresponding meaning should be determined with reference to the following description.

Figure 1:
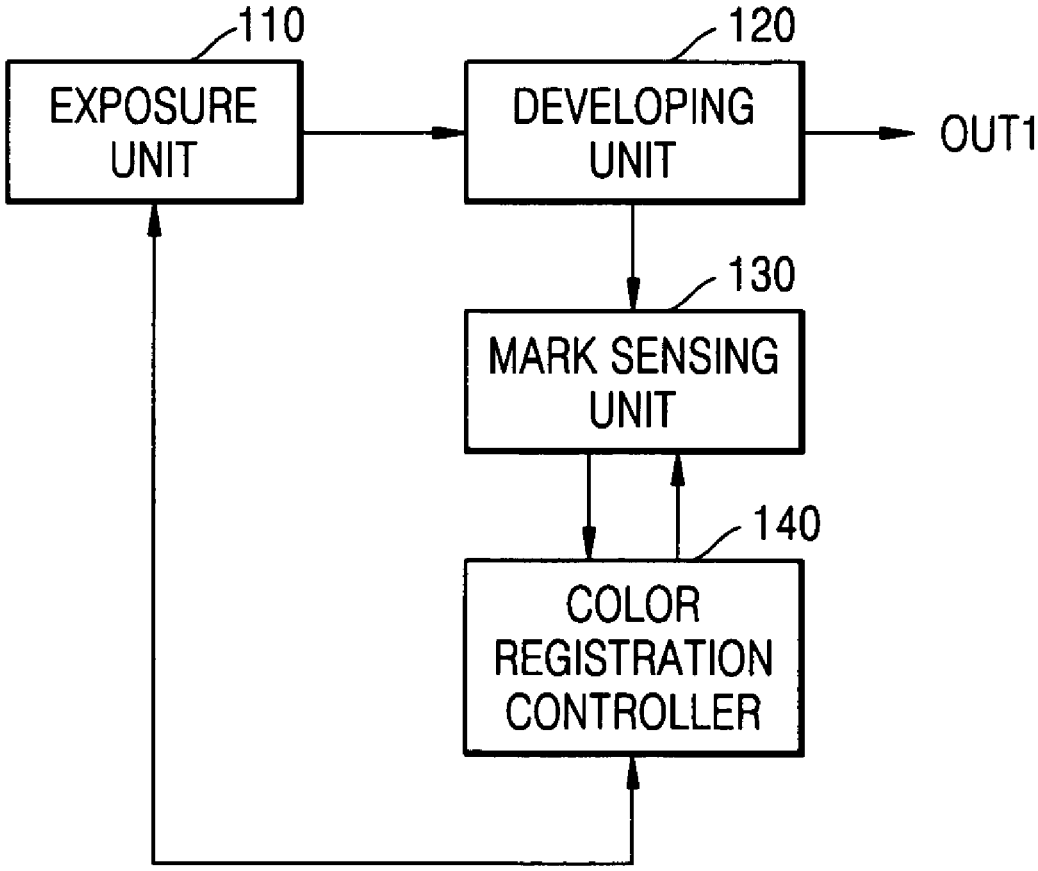
FIG. 1 is a block diagram illustrating an apparatus for correcting color registration in an electro-photographic printer in accordance with an embodiment of the present invention.

FIG. 1 is a block diagram illustrating an apparatus for correcting color registration in an electro-photographic printer according to embodiments of the present invention. The apparatus includes an exposure unit 110, a developing unit 120, a mark sensing unit 130, and a color registration controller 140.

Figure 2:
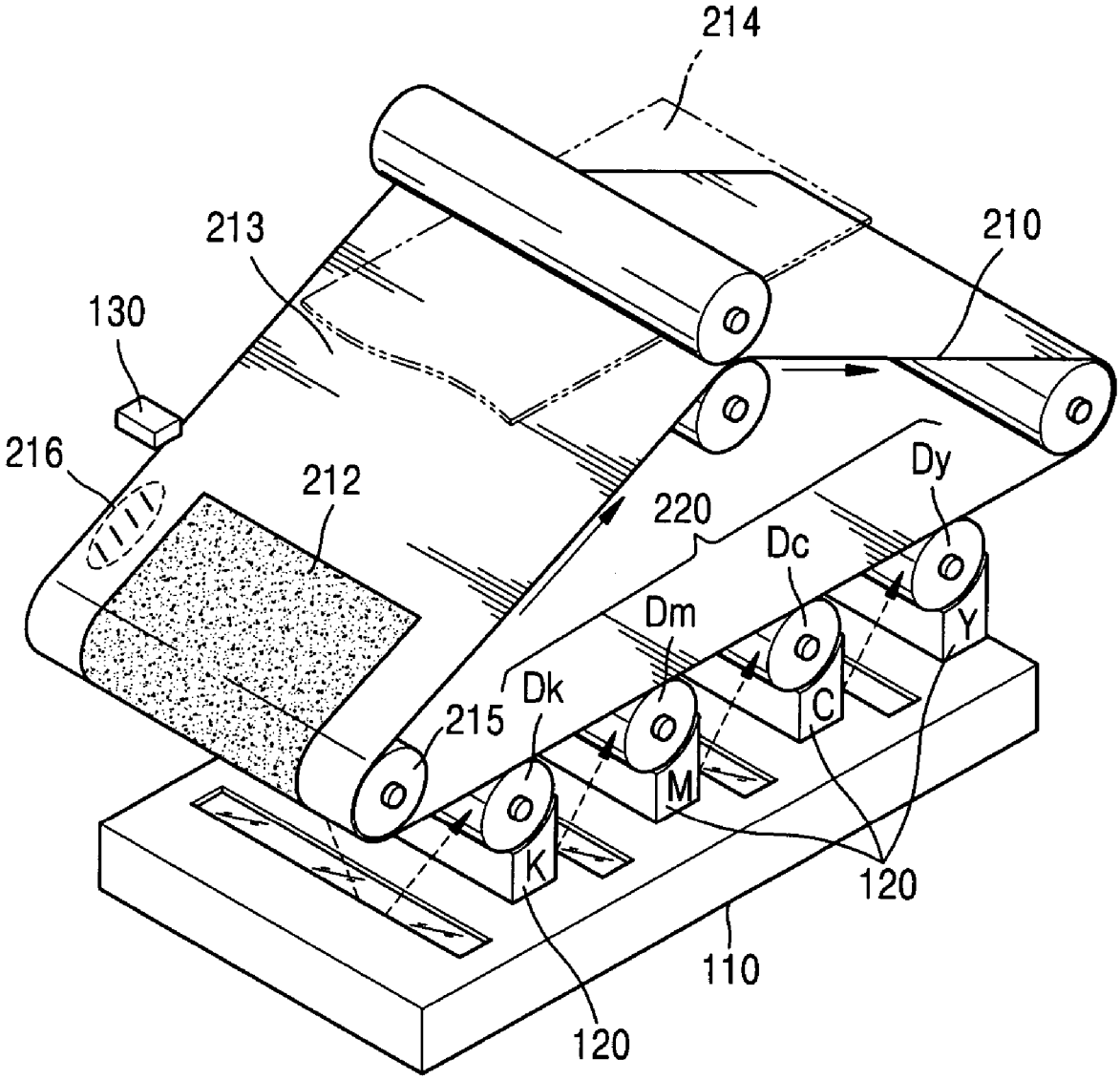
FIG. 2 is a perspective view illustrating an exemplary configuration of an exposure unit 110, a developing unit 120, and mark sensing unit 130.

FIG. 2 is a perspective view illustrating exemplary configuration of an exposure unit 110, a developing unit 120, and mark sensing unit 130. The exposure unit 110 forms particular images on the photosensitive drums 220 for each color unit. The exposure unit 110 is configured to project light beams onto the rotating photosensitive drums 220.

The exposure unit 110 may include a plurality of exposure devices corresponding to each color unit. Similarly, the developing unit 120 may include a plurality of developing devices corresponding to each color unit. Therefore, the exposure unit 110 may be a set of exposure devices or a single exposure unit. Similarly, the developing unit 120 may be a set of developing devices or a single developing unit.

In addition, the mark sensing unit 130 preferably includes a plurality of mark sensors.

The total number of the color units of the present invention is preferably four and include yellow Y, cyan C, magenta M, and black K. The photosensitive drums 220 are provided for each color unit, and the developing devices 240 are provided under each photosensitive drum 220. The exposure unit 110 is configured to project light beams onto the photosensitive drums 220 in turn for each color unit. For example, in the order of Dy, Dc, Dm, and Dk.

When the light beam is projected from the exposure unit 110 onto the photosensitive drum 220 to form a particular image, a corresponding latent image is formed on the surface of the photosensitive drum 220. The latent image is usually called an electrostatic latent image.

Before the light beam for forming a target image is projected onto the photosensitive drum 220, the light beam for forming a position mark for color registration is projected from the exposure unit 110.

The developing unit 120 develops the latent image formed on the photosensitive drum 220. The image formed on the photosensitive drum 220 may be a target image or a position mark 216. Since the photosensitive drum and the developing unit are provided for each color unit as described above, a plurality of latent images for forming a target image and a position mark 216 are developed on the photosensitive drums 220 for each color unit. In other words, the latent images corresponding to a target image and a position mark 216 may be separately developed for each color unit, such as, yellow, cyan, magenta, and black. The image carrying medium 210 is moved by rotation of the driving roller 215, and the latent image developed by the developing unit 120 is transferred onto the image carrying medium 210. A portion of the entire surface of the transfer belt, onto which an latent image is transferred, is referred to as an image area 212. The remaining area other than the image area is referred to as a non-image area. Preferably, the position mark 216 is transferred onto the non-image area 213. In FIG. 2, the exposure unit 110 preferably projects a light beam onto the photosensitive drum Dy first and then preferably projects a light beam onto the photosensitive drum Dk last; however, other suitable arrangements may be used. As a result, the latent images formed on each photosensitive drum 220 for each color unit by the exposure unit 110 are developed onto the developing unit 120. The latent images are then transferred to the image carrying medium 210 to make contact with the image carrying medium 210. Then the latent images are superimposed for each color.

The target images formed on each photosensitive drum 220 can be accurately superimposed for each color only when color registration is accurately performed. Also, a user can obtain clear prints only when the latent images are superimposed on accurate positions. The developed images superimposed onto the image carrying medium 210 for each color are pressed onto a sheet of printing paper 214 and are outputted as complete prints. The developed image is a developed latent image.

According to embodiments of the present embodiment, a mark sensing unit 130 and a color registration controller 140 are provided to ensure accurate color registration correction.

The mark sensing unit 130 detects the developed images for a predetermined time period. Preferably, the time period may be set to be longer than a time required to pass all the developed images of position marks 216 formed on the surface of the image carrying medium 210 through the mark sensing unit 130.

The mark sensing unit 130 detects a defect on the image carrying medium 210 as well as the developed images of position marks. In this case, the defect includes cracks on the surface of the image carrying medium 210.

The color registration controller 140 is configured to store information on the time points detected by the mark sensing unit 130. The color registration controller 140 controls driving of the exposure unit 110 for each color unit based on the stored time points.

When the color registration controller 140 instructs the exposure unit 110 to operate, the exposure unit 110 projects a light beam onto the photosensitive drum 220 for each color unit to form a latent image corresponding to a target image. The latent image formed on the photosensitive drum 220 is developed and transferred onto the surface of the image carrying medium 210. Then the latent image is output externally as a print 214. In other words, the exposure unit 110 projects the light beam onto the photosensitive drum 220 to provide a target image only when the color registration controller 140 instructs the exposure unit 110 to operate. In addition, the color registration controller 140 instructs the exposure unit 110 to operate only when a color registration correction value is determined. An output signal OUT1 means an image developed by the developing unit 120 after the color registration controller 140 instructs the exposure unit 110 to operate. Preferably, the output signal OUT1 is a set of developed target images for each color. On the contrary, when the exposure unit 110 forms the latent image of the position mark 216 on the photosensitive drum 220, the exposure unit 110 instructs the developing unit 120 to develop the latent image of the position mark without receiving an operation instruction from the color registration controller 140.

Now, operation of the color registration controller 140 will be described in detail with reference to FIGS. 3 through 5.

Figure 3:
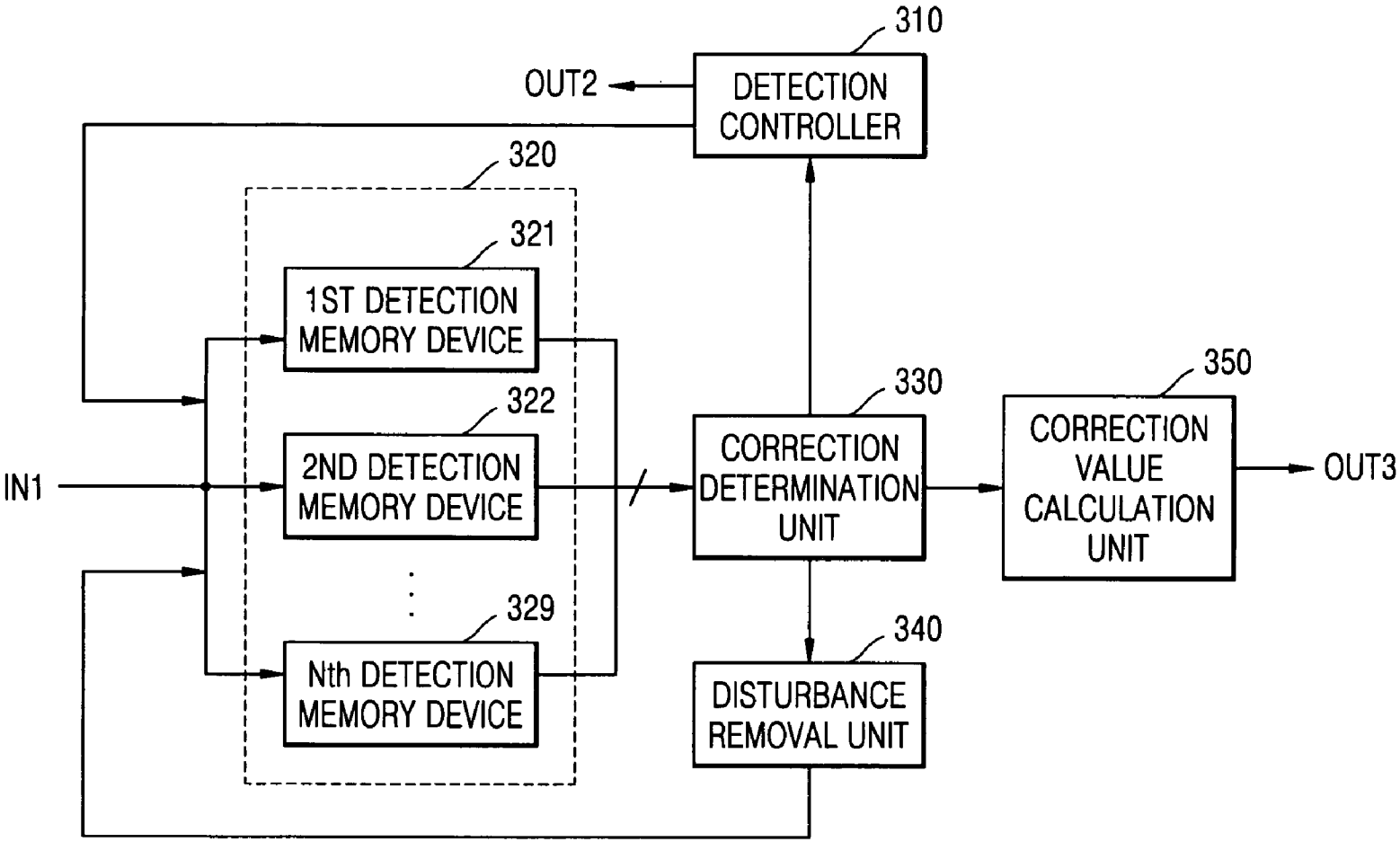
FIG. 3 is a block diagram illustrating a color registration controller of FIG. 1.

FIG. 3 is a block diagram illustrating a color registration controller of FIG. 1. The color registration controller includes a detection controller 310, a detection memory unit 320, a correction determination unit 330, a disturbance removal unit 340, and a correction value calculation unit 350.

The detection controller 310 instructs to operate the mark sensing unit 130 for a predetermined time period. An output signal OUT2 is an operation instruction signal for the mark sensing unit 130 from the detection controller 310. As described above, the mark sensing unit 130 may be configured to receive an instruction from the detection controller 310. The mark sensing unit 130 detects the defect as well as the developed image of the position mark for a predetermined time period.

The mark sensing unit 130 outputs information on the time points, at which the developed image of the position marks and the defects are detected, to the detection memory unit 320. An input signal IN1 contains information of the time points at which defects and position marks are detected. Preferably, the detection memory unit 320 includes a plurality of detection memory devices 321 through 329. Preferably, one detection memory device stores one time point. Also, the time points are stored in each detection memory device in the order of the time detected by the mark sensing unit 130. For example, the first detection memory device 321 may store a first time point at which the mark sensing unit 130 detects a first position mark. The second detection memory device 322 may store a second time point at which the mark sensing unit 130 detects a second position mark.

Preferably, the detection memory devices 321 through 329 are readable and writable. In addition, each detection memory device 321 through 329 may be set to an initial value, such as zero, before the mark sensing unit 130 detects the position mark. Consequently, the initial value may then be substituted with a detected time point. Alternatively, the time point may be stored in addition to the initial value.

Preferably, the position marks 216 are exposed for each color unit. Accordingly, if the total number of the color units is four, the number of the developed images of the position marks formed on the surface of the image carrying medium 210 is preferably selected from a group of multiples of four. In FIG. 2, the number of position marks 216 is shown as four for a convenient description, but may be selected from a group of multiples of four.

If each detection memory device stores only one time point, the number of the detection memory devices is preferably larger than the number of the position marks 216.

In other words, if the number of position marks 216 is eight, the number of detection memory devices may be nine or more.

Figure 4:
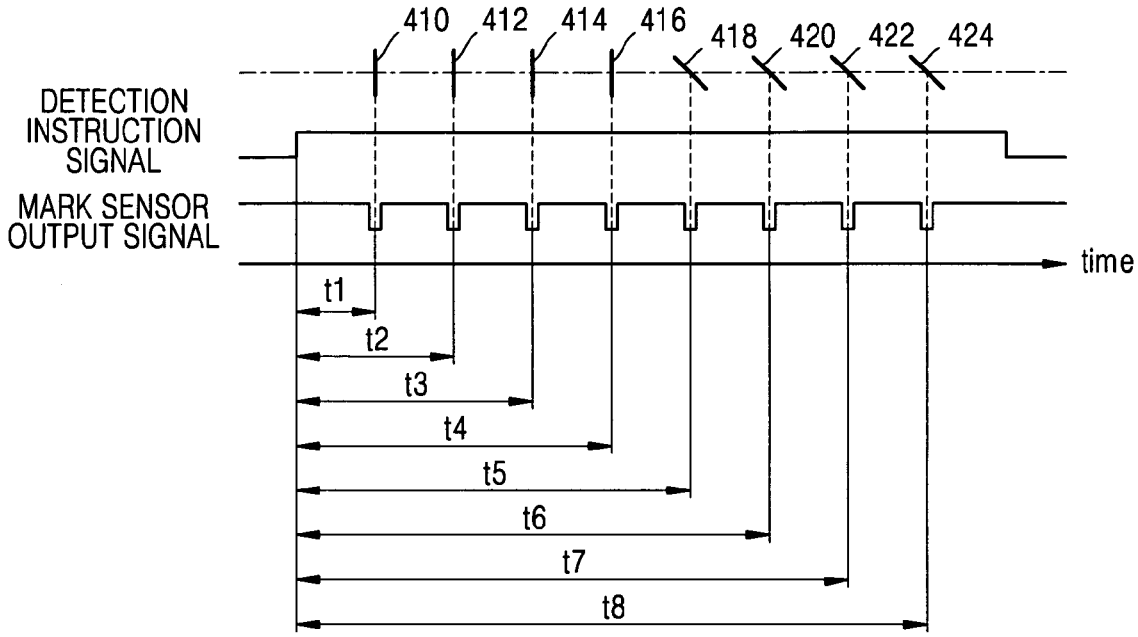
FIG. 4 is a timing chart showing a detection instruction signal and a sensor output signal when there is no disturbance.
Figure 5:
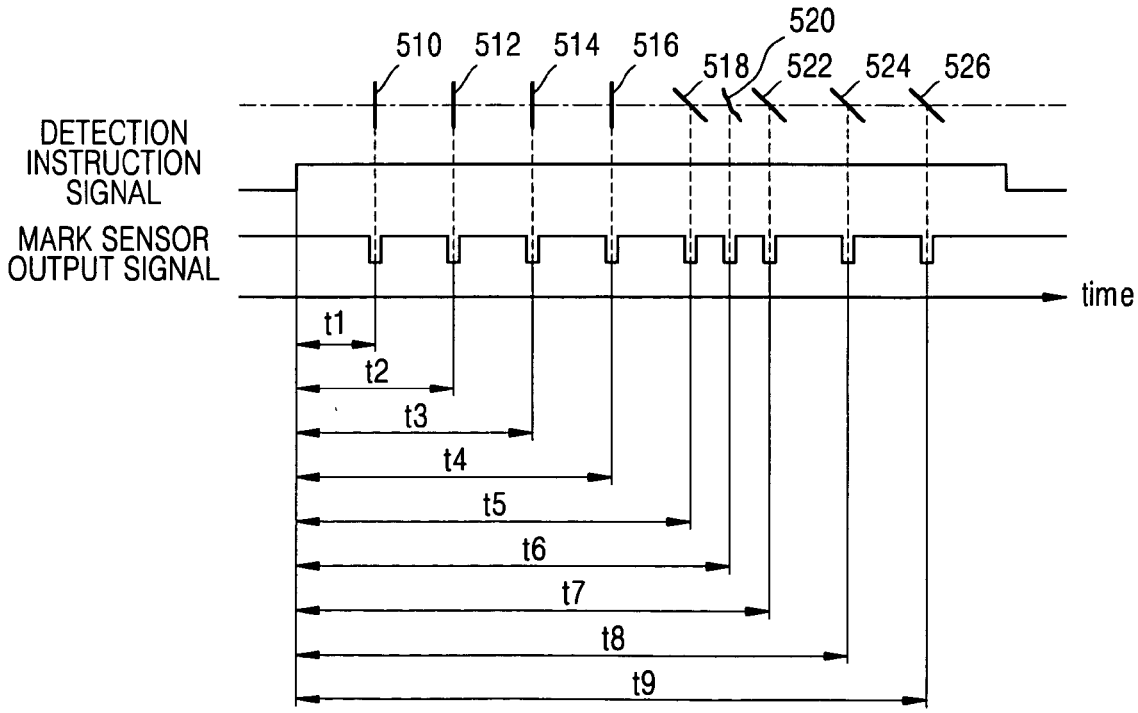
FIG. 5 is a timing chart showing a detection instruction signal and a sensor output signal when there is a disturbance.

FIG. 4 is a timing chart showing a detection instruction signal and a sensor output signal when there is no disturbance. FIG. 5 is a timing chart showing a detection instruction signal and a sensor output signal when there is a disturbance. Reference numerals 410 through 518 and 522 through 526 denote the developed images of the position marks transferred to the surface of the image carrying medium 210. This means that the exposure unit 110 projects the light beams onto the photosensitive drums 220 two times for each color unit. For example, reference numerals 410 and 418 may denote the developed images of the position marks transferred for the same color unit. Similarly, reference numerals 412 and 420 may denote the developed images of the position marks transferred for the same color unit. Reference numerals 512 and 522 may denote the developed images of the position marks transferred for the same color unit.

The detection instruction signal refers to an output signal OUT2 from the detection controller 310 for instructing the mark sensing unit 130. The sensor output signal refers to a signal containing information on the time points detected by the mark sensing unit 130. The disturbance refers to a time point detected by the mark sensing unit 130 as a position mark though it is not the developed image of the true position mark. For example, a time point at which a defect or a crack on the surface of the image carrying medium 210 is detected. Though a disturbance is not shown in FIG. 4, FIG. 5 shows one disturbance 520 detected as a developed image of a position mark. In FIG. 4, t1 through t8 denote the time lengths elapsed until the developed images of the position marks are detected. Similarly, in FIG. 5, t1 through t5 and t7 through t9 denote the time lengths elapsed until the developed images of the position marks are detected. It is shown that the time length t9 is longer than the time length t1. That means that a larger reference numeral has a larger time period.

For example, assume that the detection memory unit 320 has 9 memory devices 321 through 329. As described above, each detection memory device stores only one time point in the order of the elapsed time length. That is, in FIG. 4, a time point corresponding to the time length t1 is stored in the first detection memory device 321, and a time point corresponding to the time length t8 is stored in the eighth detection memory device 328. FIG. 5 shows a case when there is a disturbance. Assuming that a disturbance is generated at the time point 520, since the mark sensing unit 130 is operated to detect even a crack (that is, disturbance) on the image carrying medium 210 as a developed image of a position mark, the time point 520 is also stored in the sixth detection memory device 326 as a position mark. Similarly, the time point at which the mark 526 corresponding to the elapsed time length t9 is detected should be stored in the ninth detection memory device 329. However, if the detection memory unit 320 includes only eight memory devices, since the time point corresponding to a disturbance 522 occupies one of the detection memory units, the time point at which the mark 526 corresponding to a true position mark is detected can not be stored in one of the detection memory devices.

Therefore, the detection memory unit 320 preferably has a plurality of detection memory devices in order to not lose information on the detected position marks. In other words, the number of the time points that may be stored in the detection memory unit 320 is preferably set to be larger than the number of the developed images of the position marks 216 even when each memory device can store one or more time points. In FIG. 2, the number of the developed images of the position marks 216 is four. Accordingly, the number of the time points that can be stored in the detection memory unit 320 should be equal to or larger than 5.

The correction determination unit 330 determines whether or not color registration correction is permissible based on information on the time points stored in the detection memory unit 320. More specifically, if the correction determination unit 330 determines that correction is not permissible, the color registration controller 140 instructs not to calculate color registration correction values, and the exposure unit 110 is made to project light beams on the photosensitive drums 220 according to existing exposure start points.

On the contrary, if the correction determination unit 330 determines that correction is permissible, the color registration controller 140 calculates new color registration correction values, and the exposure start points of the exposure unit 110 is adjusted based on the new color registration correction values to correct registration errors.

The correction determination unit 330 determines that the correction is permissible when the number of the time points stored in the detection memory unit 320 is equal to the number of the position marks 216. More specifically, the correction determination unit 330 regards all the position marks as being detected without any disturbance. The correction determination unit 330 also instructs the correction value calculation unit to calculate the correction values when the number of the time points stored in the detection memory unit 320 is equal to the number of the position marks 216. In this case, the number of the time points that can be stored in the detection memory unit 320 is preferably larger than the number of the position marks 216. In addition, the initial values stored in the detection memory unit 320 are preferably substituted with the detected time points.

The correction determination unit 330 determines that the correction is not permissible when the number of the time points stored in the detection memory unit 320 is smaller than the number of the developed images of the position marks. This is because this condition may be generated when the mark sensing unit 130 does not appropriately operate. In this case, the correction determination unit 330 notifies the detection controller 310 that the correction is not permissible, and the detection controller 310 instructs the mark sensing unit 130 to perform detection again by sending an output signal OUT2.

The correction determination unit 330 also determines that the correction is not permissible when the number of the time points stored in the detection memory unit 320 is larger than the number of the position marks 216. This is because this condition may be generated when the detection memory unit 320 contains a time point corresponding to a disturbance. In this case, the correction determination unit 330 instructs the disturbance removal unit 340 to remove the information on the time point corresponding to a disturbance from the detection memory unit 320. Accordingly, the disturbance removal unit 340 searches all the information of time points stored in the detection memory unit 320 to find a time point which does not correspond with an expected timing value. Thus, the found time point is changed to its initial value. The expected timing value is an expected detected time point for each developed image of the position mark 216. The expected timing value is set with a predetermined time interval.

More specifically, the expected timing value is preferably set based on a rotation speed of the photosensitive drum 220, a rotation speed of the driving roller 215, an exposure start point of the exposure unit 110 for each color unit, and a portion of the surface of each photosensitive drum 220 from which exposure is initiated. Preferably, the expected timing values are set by the detection controller 310 before the correction determination unit 330 starts to operate. The expected time values are then stored in an expected timing value storage (not shown). The expected timing values set by the detection controller 310 are transmitted to the correction determination unit 330. The correction determination unit 330 notifies the expected timing values to the disturbance removal unit 340. Accordingly, the disturbance removal unit 340 compares the time points stored in the detection memory unit 320 with corresponding expected timing values. As a result, if one of the time points stored in the detection memory unit 320 is not within an allowed error range, the time point that is not within the allowed error range is changed into its initial value.

In other words, since each of the expected timing values is generated by expecting time points at which each developed image of the position mark should be detected, each expected timing value has a predetermined time-length range; for example, an allowed error range.

After the disturbance removal unit 340 completes its task, the correction determination unit 330 determines whether or not the correction is permissible over again. In other words, after the operation of the disturbance removal unit 340 is completed, the correction determination unit 330 determines whether or not the number of the time points stored in the detection memory unit 320 is equal to the number of the position marks 216. As a result, if the number of the time points is equal to the number of the position marks 216, the correction determination unit 340 allows the correction and instructs the correction value calculation unit 350 to calculate the color registration correction value based on the stored time points.

Otherwise, if the number of the time points stored in the detection memory unit 320 is larger than the number of the position marks 216, the correction determination unit 330 may instruct the disturbance removal unit 340 or the detection controller 310 to operate again.

In other words, when the disturbance removal unit 340 operates again, the disturbance removal unit 340 searches all the time points stored in the detection memory unit 320 to find a time point that does not correspond with an expected timing value. Consequently, the found time point is changed to its initial value.

When the detection controller 310 operates again, the mark sensing unit 130 senses the surface of the image carrying medium 210 again and updates the time points stored in the detection memory unit 320. Then, the correction determination unit 330 determines whether or not the correction is permissible again by using an updated version of time points stored in the detection memory unit 320. The correction determination unit then instructs the disturbance removal unit 340, the detection controller 310, or the correction value determination unit 350 depending on the result of the determination.

Meanwhile, the number of the time points stored in the detection memory unit 320 may be larger than the number of the time position marks even after the disturbance removal unit 340 operates over again. This is because the time point corresponding to a disturbance may be within the allowed error range of the expected timing value. That is, the disturbance removal unit 340 cannot read out the time point corresponding to a disturbance if the detected time point is with the allowed error range. In this case, the correction determination unit 330 also determines that the correction is not permissible.

Whenever the correction determination unit 330 determines that the correction is not permissible over again due to the disturbance, an accumulated number of correction disallowance is simultaneously counted. If the accumulated number of correction disallowance is smaller than a predetermined threshold comparison number, the correction determination unit 330 instructs the disturbance removal unit 340 to operate over again. If the accumulated number of correction disallowance is equal to or larger than the threshold comparison number, the correction determination unit 330 instructs the correction value calculation unit 350 to calculate the color registration correction values. Based on the color registration correction value, the correction value calculation unit 350 determines a new exposure start point based on the time points stored in the detection memory unit 320. If the number of correction disallowance becomes equal to the critical comparison number. The threshold comparison number may be arbitrarily selected by a user.

If the correction determination unit 330 determines that the number of the time points stored in the detection memory unit 320 is larger than the number of the position marks due to the disturbance generated within the error range of the expected timing value, the correction determines unit 330 may instruct the disturbance removal unit 340 to operate over again as described above. Also, the correction determination unit 330 may instruct the detection controller 310 to operate.

The correction value calculation unit 350 calculates color registration correction values based on the time points stored in the detection memory unit 320 when the correction value calculation unit 350 starts to operate. An output signal OUT3 containing a new color registration correction value is transmitted to the exposure unit 110. The exposure unit 110 receives the output signal OUT3 rearranges the exposure start points based on the new color registration correction value to project corrected light beams onto the photosensitive drums 220.

Figure 6:
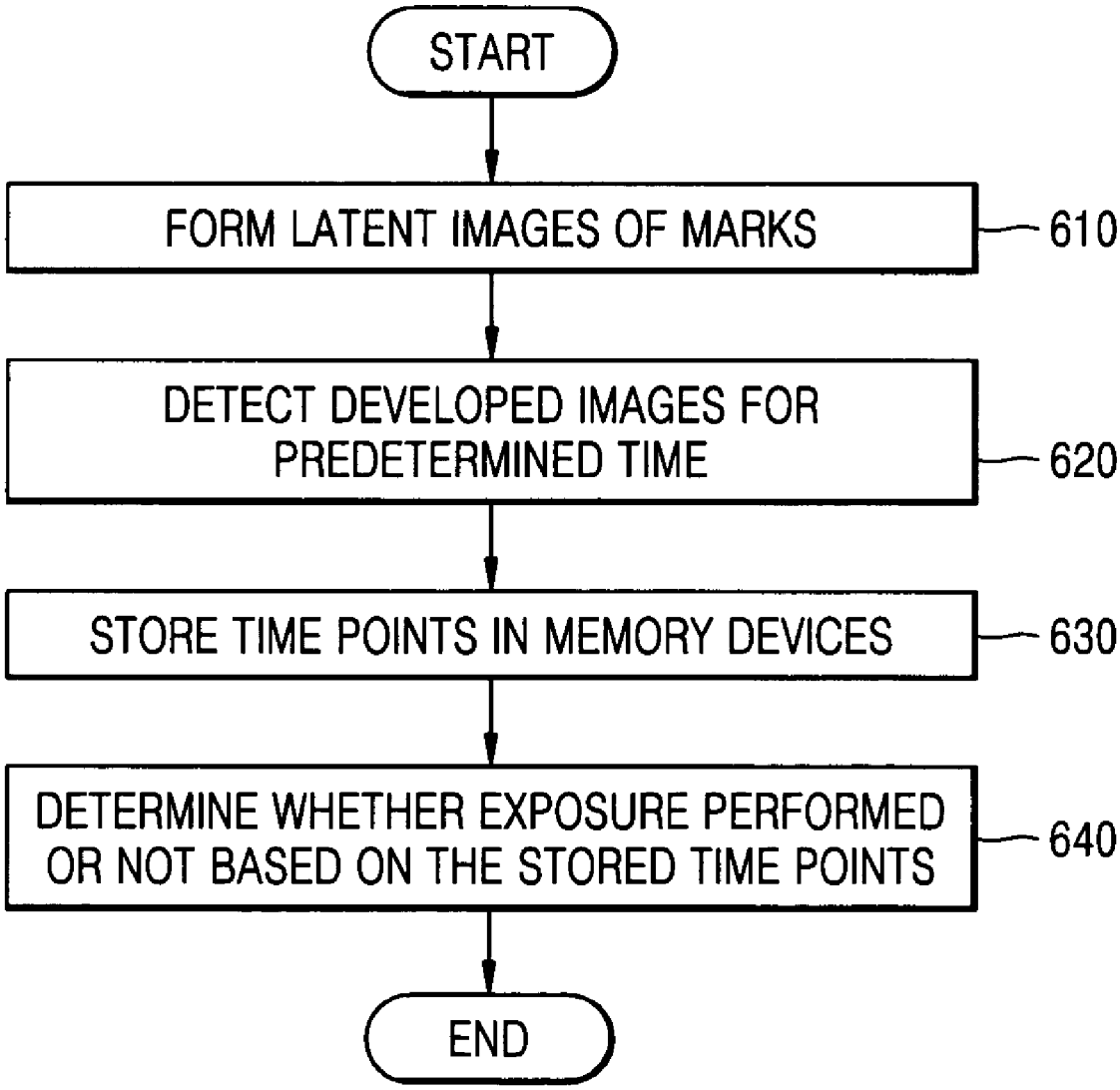
FIG. 6 is a flowchart for describing a method of correcting color registration in an electro-photographic printer in accordance with an embodiment of the present invention.

FIG. 6 is a flowchart for describing a method of correcting color registration in an electro-photographic printer in accordance with an embodiment of the present invention. The method includes forming position marks (operation 610); detecting time points corresponding to the developed images of the position marks for a predetermined time period (operation 620); storing the detected time points (operation 630); and determining whether or not exposure should be started based on the stored time points (operation 640).

The exposure unit 110 projects light beams onto the surface of the photosensitive drum 220 to form the position mark, and a latent image corresponding to the position mark on the photosensitive drum 220 is developed by a developing unit 120. The image is then transferred to the surface of the image carrying medium 210 (operation 610). Accordingly, the developed image of the position mark now exists on the surface of the image carrying medium 210.

The mark sensing unit 130 detects the surface of the image carrying medium 210 for a predetermined time period to detect the developed image of the position mark 216 (operation 620). In this case, if there is a defect or crack on the surface of the image carrying medium 210, the mark sensing unit 130 may detect the defect as a position mark 216. The time point corresponding to the defect is regarded as a disturbance.

The detection memory unit 320 stores the time point sensed by the mark sensing unit 130 (operation 630). Then, the correction determination unit 330 compares the number of the stored time points with the number of the position marks to determine whether or not exposure should be started (operation 640).

Figure 7:
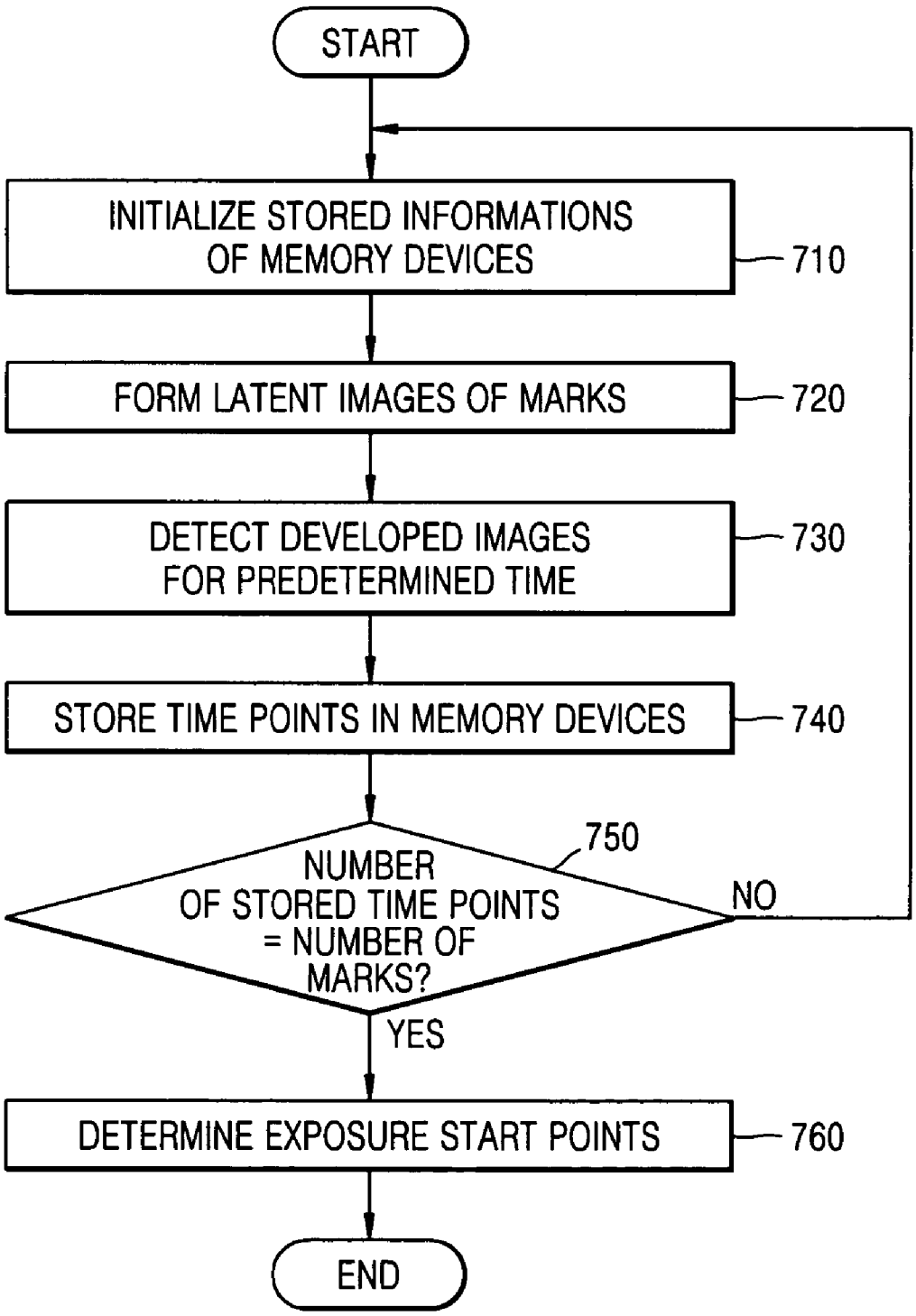
FIG. 7 is a flowchart for describing a method of correcting color registration in an electro-photographic printer in accordance with another embodiment of the present invention.

FIG. 7 is a flowchart for describing a method of correcting color registration in an electro-photographic printer according to another embodiment of the present invention. The method includes initializing time points stored in a detection memory unit (operation 710); forming position marks, detecting them for a predetermined time period; and storing the sensed time points in a detection memory unit (operation 720 through 740); and comparing the number of the stored time points with the number of the position marks to determine whether or not an exposure should be started (operation 750 through 760).

The detection controller 310 sets up all the time points stored in the detection memory unit 320 to their initial values to initialize the detection memory unit 320 (operation 710). Then, operations 720 through 740 take place which are similar to operation 620 through 640 which has been already described. Consequently, their descriptions will be omitted for clarity and conciseness.

After operation 740, the correction determination unit 330 compares the number of the time points stored in the detection memory unit 320 with the number of position marks 216 (operation 750). As a result, if the number of the time points stored in the detection memory unit 320 is equal to the number of the position marks, the correction value calculation unit 350 calculates color registration correction values, and the exposure unit 110 rearranges the exposure start point based on the calculated color registration correction values (operation 760).

As a result of operation 750, if the number of the time points is not equal to the number of the position marks, the detection controller 310 initializes all the time points stored in the detection memory unit 320 again.

Figure 8:
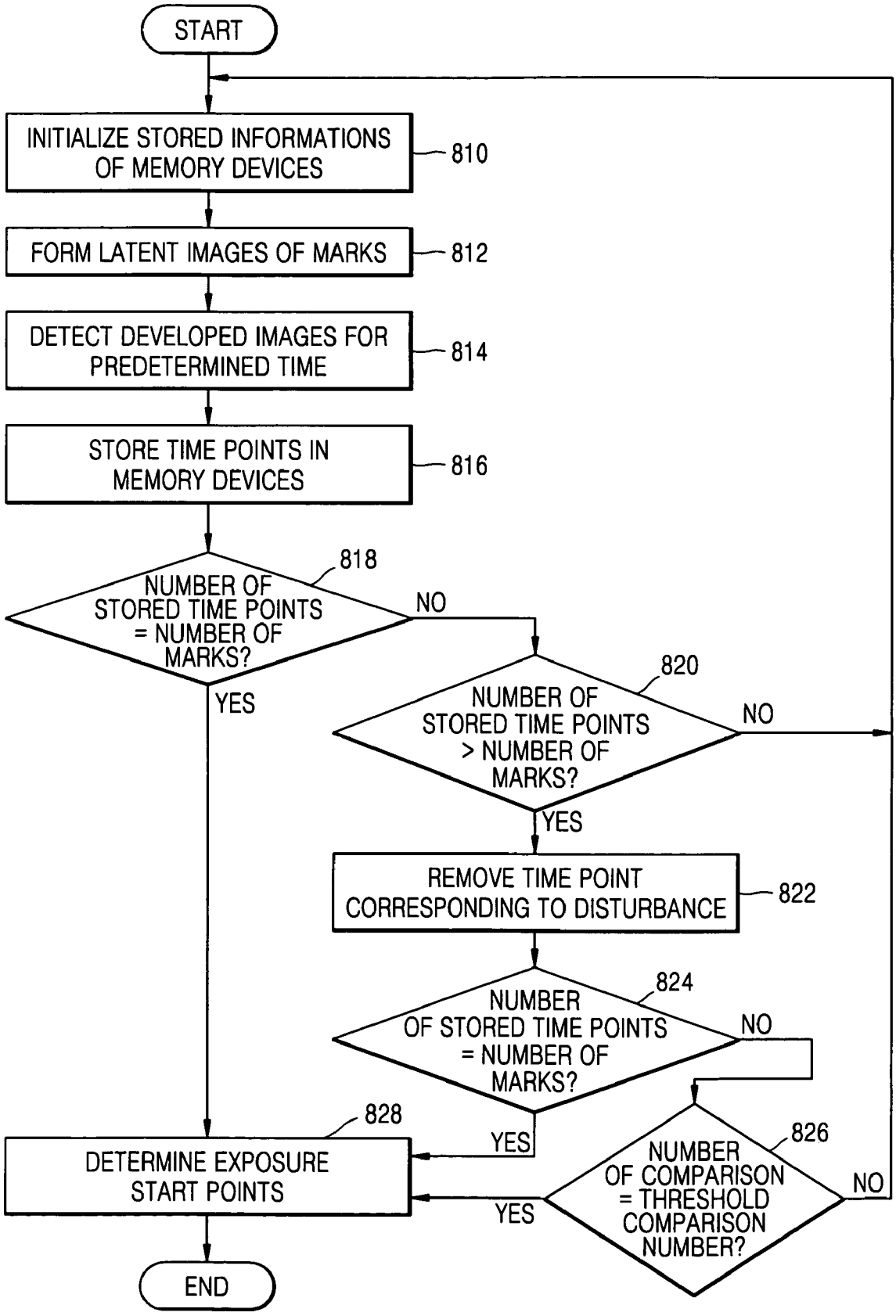
FIG. 8 is a flowchart for describing a method of correcting color registration in an electro-photographic printer in accordance with another embodiment of the present invention.

FIG. 8 is a flowchart for describing a method of correcting color registration in an electro-photographic printer in accordance with another embodiment of the present invention. The method includes forming position marks and determining whether or not correction is permissible (operation 810 through 818); removing time points corresponding to a disturbance (operation 820 through 822); and determining whether or not correction is permissible again (operation 824 through 828).

Operation 810 through 818 is similar to operation 710 through 750, and their descriptions will be omitted for clarity and conciseness.

After operation 818, if the number of the time points stored in the detection memory unit is larger than the number of the position marks (operation 820), the disturbance removal unit 340 searches all the time points stored in the detection memory unit to find a time point that does not correspond with an expected timing value within an allowed error range. These changes the found time point is changed to its initial value (operation 822).

Then, the correction determination unit 330 determines whether or not the number of the time points stored in the detection memory unit is equal to the number of the position marks again (operation 824). As a result, if the number of the time points stored in the detection memory unit is equal to the number of the position marks, the correction value calculation unit 350 calculates color registration correction values (operation 828).

In operation 824, if the number of the time points stored in the detection memory unit is not equal to the number of the position marks, the detection controller 310 initializes all the time points stored in the detection memory unit 320 again. However, in operation 824, even when the number of the time points stored in the detection memory unit is not equal to the number of the position marks, if an accumulated number of correction disallowance is equal to a threshold comparison number, the correction value calculation unit 350 calculates the color registration correction values based on the time points stored in the detection memory unit 320 at the time corresponding to the threshold comparison number.

After operation 818, if the number of the time points stored in the detection memory unit is smaller than the number of the position marks (operation 820), the detection controller 310 initializes all the time points again.

In operation 818, if the number of the time points stored in the detection memory unit is equal to the number of the position marks, the correction value calculation unit 350 calculates color registration correction values (operation 828).

According to the present invention, it is possible to provide an apparatus for and a method of correcting color registration in an electro-photographic printer even when there is a disturbance on the surface of the image carrying medium.

The invention may also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing embodiments of the present invention can be easily construed by programmers skilled in the art to which the present invention pertains.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An apparatus for correcting color registration in an electro-photographic printer, in which exposure start points of each color unit for a photosensitive drum are adjusted to superpose images developed in a plurality of colors on matching positions of an image carrying medium, the apparatus comprising:

an exposure unit for projecting light beams on the photosensitive drum to form latent images of one or more marks for each color unit;

a developing unit for generating developed images by developing the latent images of the marks;

a mark sensing unit for detecting the developed images transferred on a surface of the image carrying medium for a predetermined time period; and a color registration controller for storing information on time points at which the developed images are detected for comparing the number of the time points with the number of the marks, and for controlling the exposure start points in response to the compared result.

2. The apparatus according to claim 1, wherein the color registration controller comprises:

a detection memory unit for storing the time points detected by the mark sensing unit;

a correction determination unit for determining whether or not the number of the time points is equal to the number of the marks; and a correction value calculation unit for calculating the exposure starts points of the exposure unit for each color unit based on the time points stored in the detection memory unit if the number of the time points is equal to the number of the marks.

3. The apparatus according to claim 2, wherein the detection memory unit has detection memory devices more than the number of the marks and controls the exposure unit for each color unit based on the time points stored in the detection memory devices, and each of the detection memory devices is configured to store information on only one time point and to be initialized if the information on the time point is not stored.

4. The apparatus according to claim 1, wherein the color registration controller further comprises a detection controller for instructing the mark sensing unit to operate for a predetermined time period, the predetermined time period being longer than a time period required for the mark sensing unit to detect the developed images.

5. The apparatus according to claim 4, wherein the detection controller initializes the information stored in the detection memory unit if the number of the time points stored in the detection memory unit is not equal to the number of the marks.

6. The apparatus according to claim 4, wherein the color registration controller further comprises a disturbance removal unit for initializing a stored time point which is not within an allowed error range of an expected timing value if the number of the time points stored in the detection memory unit is not equal to the number of the marks, and the expected timing value is obtained by predicting a time point to be detected by the detection controller.

7. A method of correcting color registration in an electrophotographic printer, in which exposure start points of each color unit for a photosensitive drum are adjusted to superpose images developed in a plurality of colors on matching positions of an image carrying medium, the method comprising:

forming latent images of one or more marks on the photosensitive drum for each color unit by projecting light beams onto the photosensitive drum;

developing the latent images of the marks formed on the photosensitive drum and transferring the developed images onto the image carrying medium;

detecting the developed images transferred onto the image carrying medium for a predetermined time period;

storing information on time points at which the developed images are detected; and comparing the number of the stored time points with the number of the marks and adjusting the exposure start points in response to the compared result, wherein the developed image is generated by developing the latent images.

8. The method according to claim 7, wherein the time points are stored in detection memory devices more than the number of the marks, and each of the detection memory devices is initialized if the time point is not stored.

9. The method according to claim 8, further comprising initializing the detection memory devices before the latent images of the marks are formed on the photosensitive drum.

10. The method according to claim 7, wherein adjusting the exposure start points comprises:

determining whether or not the number of the marks is equal to the number of the stored time points; and determining the exposure start points for each color unit by using the stored time points if the number of the marks is equal to the number of the stored time points.

11. The method according to claim 7, wherein adjusting the exposure start points comprises:

determining whether or not the number of the marks is equal to the number of the stored time points; and initializing the stored time points and performing the detection of the developed images again if the number of the marks is not equal to the number of the stored time points.

12. The method according to claim 7, wherein adjusting the exposure start points comprises:

determining whether or not the number of the marks is equal to the number of the stored time points; and performing the detection of the developed images again if the number of the stored time points is smaller than the number of the marks.

13. The method according to claim 7, wherein adjusting the exposure start points comprises:

determining whether or not the number of the marks is equal to the number of the stored time points;

detecting a time point corresponding to a disturbance if the number of the stored time points is larger than the number of the marks; and initializing the detected time point corresponding to the disturbance and determining whether or not exposure should be started for each color unit based on the stored time points, and wherein the time point corresponding to the disturbance is detected by searching a time point that does not correspond with an expected timing value within an allowed error range, the expected timing value being predetermined by predicting a time point at which the developed image is to be detected.

14. The method according to claim 13, wherein determining whether or not exposure should be started for each color unit based on the stored time points comprises:

initializing the detected time point corresponding to the disturbance and then comparing the number of the stored time points with the number of the marks; and determining exposure start points for each color unit based on the time points detected after the initialization if the number of the stored time points is equal to the number of the marks.

15. The method according to claim 13, wherein determining whether or not exposure should be started for each color unit based on the stored time points comprises:

initializing the detected time point corresponding to the disturbance and then comparing the number of the stored time points with the number of the marks; and performing the detection of the developed images again if the number of the marks is not equal to the number of the stored time points.

16. The method according to claim 15, wherein performing the detection of the developed images again comprises:

calculating a number of comparison if the number of the marks is not equal to the number of the stored time points; and performing the detection of the developed images again if the number of comparison is smaller than a threshold comparison number.

17. The method according to claim 15, wherein performing the detection of the developed images again comprises:

calculating a number of comparison if the number of the marks is not equal to the number of the stored time points; and determining exposure start points for each color unit based on the time points detected for a time period corresponding to the threshold comparison number if the number of comparison is equal to the threshold comparison number.

18. The method according to claim 17, wherein performing the detection of the developed images again further comprises notifying that a registration error cannot be corrected.

19. A computer readable medium of instructions for controlling a system for recording a system to correct color registration in an electro-photographic printer, in which exposure start points of each color unit for a photosensitive drum are adjusted to superpose images developed in a plurality of colors on matching positions of an image carrying medium, comprising:

a first set of instructions configured to control the system to form latent images of one or more marks on the photosensitive drum for each color unit by projecting light beams onto the photosensitive drum;

a second set of instructions configured to control the system to develop the latent images of the marks formed on the photosensitive drum and transferring the developed images onto the image carrying medium;

a third set of instructions configured to control the system to detect the developed images transferred onto the image carrying medium for a predetermined time period;

a fourth set of instructions configured to control the system to store information on time points at which developed images are detected; and a fifth set of instructions configured to control the system to compare the number of the stored time points with the number of the marks and adjusting the exposure start points in response to the compared result, wherein the developed image is generated by developing the latent image.

* * * * *